United States Patent [19]

Tarlton

[11] Patent Number: 4,934,010

[45] Date of Patent: Jun. 19, 1990

[54] SEWING AID

[76] Inventor: Mabel L. Tarlton, 6162 Forty Winks Way, Columbia, Md. 21045

[21] Appl. No.: 325,144

[22] Filed: Mar. 17, 1989

[51] Int. Cl.[5] ..... A46B 5/02

[52] U.S. Cl. ..... 15/104 A; 112/257; 112/282; 15/160

[58] Field of Search ..... 112/282, 257, 302, 286, 112/803; 15/104 A, 160

[56] References Cited

U.S. PATENT DOCUMENTS

| | | | |
|---|---|---|---|
| 2,693,610 | 11/1954 | Hensley, Jr. | 15/104 A |
| 3,040,352 | 6/1962 | Vian | 15/104 A |
| 3,299,401 | 1/1967 | Marks | 15/104 A |
| 3,373,457 | 3/1968 | Rouch, Jr. | 15/104 A |

FOREIGN PATENT DOCUMENTS

| | | | |
|---|---|---|---|
| 2189983 | 11/1987 | United Kingdom | 15/104 A |
| 220422A | 11/1988 | United Kingdom | 15/104 A |

*Primary Examiner*—Frankie L. Stinson

*Attorney, Agent, or Firm*—Morton J. Rosenberg; David I. Klein

[57] ABSTRACT

A sewing aid (10) is provided for capturing loose threads. The sewing aid (10) includes means (50) for releasably coupling sewing aid (10) to a sewing machine (90). Sewing aid (10) includes a body member (20) having a pair of extending legs (28 and 29) defining a U-shaped contour for body member (20). A continuous adhesive web (40) encompasses one of the pair of extending legs (28 or 29) and is in frictional engagement therewith. The adhesive web (40) is slidingly displaceable on the leg (28 or 29) to allow exposure of a fresh adhesive surface (41) previously maintained within the slot (27).

14 Claims, 2 Drawing Sheets

SEWING AID

FIELD OF THE INVENTION

This invention directs itself to devices which capture loose threads or other sewing debris placed thereon by a user. Alternatively, this invention device may be used for removing loose threads from work pieces and work surfaces by those engaged in the art of sewing. In particular, this invention directs itself to a small compact device having a body member formed in one-piece formation to provide the advantage of simplicity of construction and ease of use. Still further, this invention directs itself to a sewing aid wherein a one-piece body member is formed in a U-shaped configuration defined by a pair of extending legs. More in particular, this invention pertains to sewing aids having a continuous adhesive web encompassing one of the body member legs. The web being formed by an adhesive tape strip having a first end in overlapping engagement with a second end to form a continuous loop in frictional engagement with the body member leg. Further, the continuous loop of adhesive tape is slidingly displaceable about the leg to allow a fresh adhesive surface to be exposed in replacement of portions of the tape loop where the adhesive has been consumed.

PRIOR ART

Adhesive systems for removing thread-like materials from cloth surfaces are known in the art. The best prior art known to the Applicant include U.S. Patents #3,040,352; #2,755,494; #2,708,761; #3,299,461; #3,289,416; #4,083,075; #4,427,726; #4,727,616; #2,430,785; #3,329,985; #3,846,248; #2,807,039; #2,528,602; and, #2,658,217.

Some prior art systems, such as that shown in U.S. Patents #3,040,352; #2,755,494; and, #2,708,761 are directed to lint removers having body portions coupled to handle portions and having an endless web of adhesive material in the form of a roll or continuous loop. However, such systems are relatively large, requiring a handle portion extending from the body portion in order to be utilized without the user coming in contact with the adhesive surface. Further, these systems do not provide a means for releasably coupling the body portion to a supporting structure, such as a sewing machine.

SUMMARY OF THE INVENTION

A sewing aid for capturing loose threads is provided. The sewing aid includes a body member having a pair of extending legs which define a U-shaped contour. The sewing aid further includes an adhesive web releasably coupled to one of the pair of legs of the body member for adhesively securing loose threads thereto. A releasable coupling is also provided coupled to the other body member leg, not having the adhesive web, for releasably coupling the body member to a convenient structure such as a sewing machine.

DESCRIPTION OF THE PREFERRED EMBODIMENTS

Referring now to FIGS. 1–5, there is shown sewing aid 10 for capturing loose threads placed thereon by a user after removal from a work surface. As will be seen in following paragraphs, sewing aid 10 is specifically directed to the concept of providing a small compact device adaped to be releasably coupled to a sewing machine 90 for convenience of use therewith. Although not restricted to use associated with a sewing machine, sewing aid 10 is particularly adapted for adhesively securing loose threads which provides in one alternate use a compact means for handling loose threads without coming in contact with the adhesive surface. Additionally, sewing aid 10 is provided with a convenient means for releasable securement to a sewing machine or other convenient structure in the vicinity of a sewing operation.

Figure 1:
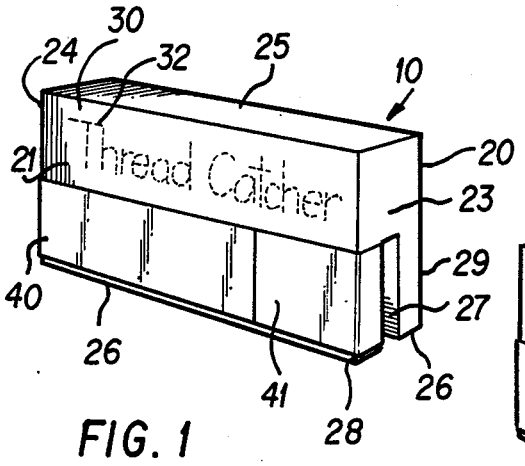
FIG. 1 is a front perspective view of the sewing aid.
Figure 2:
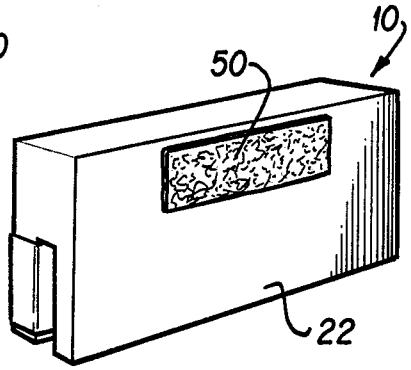
FIG. 2 is a rear perspective view of the sewing aid.
Figure 3:
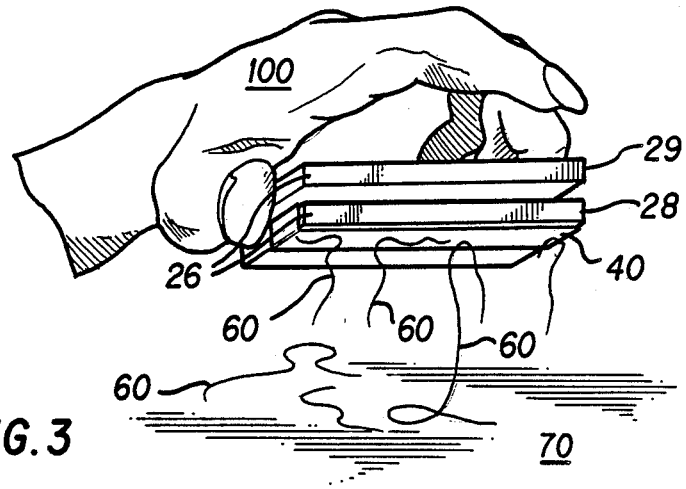
FIG. 3 is a perspective view depicting utilization of the sewing aid in an alternate manner where the user may grasp the sewing aid and remove loose threads from a surface.

As shown in FIGS. 1–3, sewing aid 10 includes a body member 20 having a pair of extending legs 28 and 29 defining a U-shaped contour for body member 20. Encompassing one of the legs 28, for example, there is provided an adhesive web 40 having an adhesive coated outer surface 41 for adhesively securing loose threads, as shown in FIG. 3.

The configuration of body member 20 is particularly important to the inventive concept of sewing aid 10. Body member 20 is defined by a pair of opposing faces 21 and 22 which are bound by a plurality of end walls 23, 24, 25 and 26 and having a slotted opening 27 extending between at least a portion of two opposing end walls 23, 24 and open to another end wall 26 extending therebetween. This unique configuration allows the adhesive web 40 to encompass a portion of the front face 21 corresponding to the depth of slot 27. The remaining portion of front face 21 provides a space 30 for indicia 32 which may be printed, engraved, or otherwise formed thereon. The indicia may serve an informative function, such as providing instructions for the replacement of adhesive web 40, a decorative function for making sewing aid 10 aesthetically attractive, or a combination thereof.

Further, the unique structure of body member 20, having an adhesive web passing through a slot 27 to encompass the leg 28 of the U-shaped structure, allows sewing aid 10 to be easily handled and utilized without the user's hand 100 coming in contact with the adhesive web 40, and thereby consume its adhesive properties prematurely.

Figure 5:
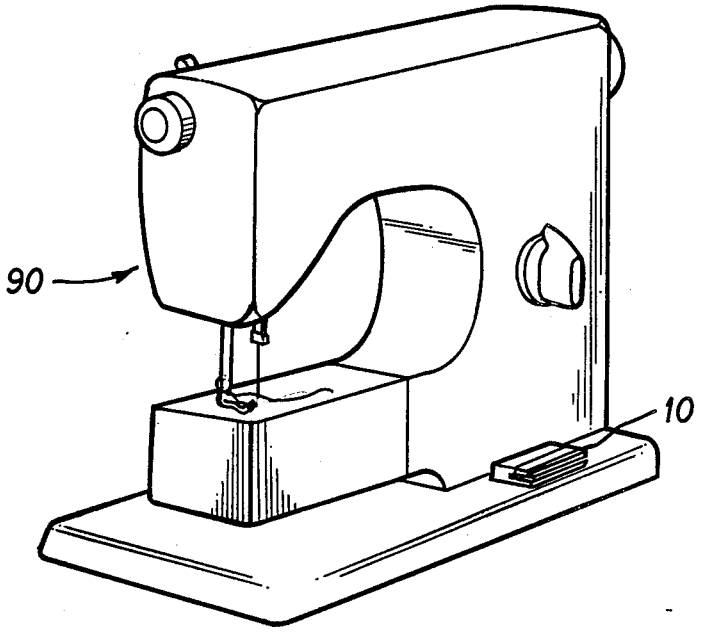

Referring to FIGS. 2 and 5, sewing aid 10 is provided with means for releasably coupling body member 20 to a convenient structure, such as sewing machine 90 and thus providing a convenient storage and use location in close proximity to the area where utilization of sewing aid 10 will be required in order that loose threads or other sewing debris may be easily placed thereon by the user. To this end, body member 20 is provided with one portion 50 of a hook and loop type fastening system, such as provided under the Trademark Velcro. The other portion of the hook and loop type fastening system, not shown, is adhesively coupled to the sewing machine 90. While a Velcro type fastening system has been successfully used in one working embodiment, it is contemplated that other releasable fastening systems could satisfactorily function without departing from the inventive concept.

In one working embodiment, body member 20 is formed from a single block of wood approximately three and a half inches long, two inches wide and three-quarters of an inch thick. Although not important to the inventive concept, body member 20 may be formed from other materials such as plastic, metal or ceramic compositions which may be molded, extruded or machined to form a unitary one-piece body, or in the alternative, formed of multiple pieces fixedly coupled together.

Figure 4:
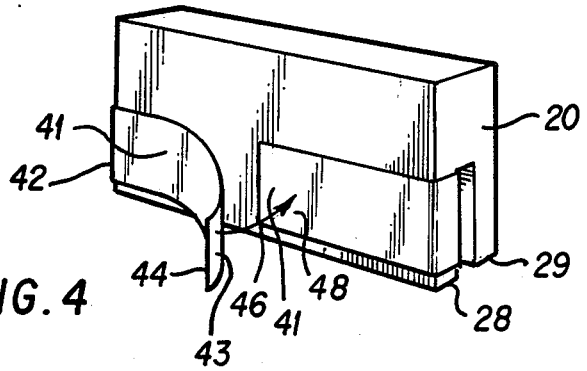
FIG. 4 is a perspective view showing application of an adhesive member to the sewing aid body; and, FIG. 5 is a perspective view of a sewing machine with the sewing aid coupled thereto.

Adhesive web 40, as shown in FIG. 4, is formed into a continuous loop by encompassing one of the leg portions 28, for example, with a strip of adhesive tape 42 having its adhesive surface 41 facing outward and its back, non-adhesive, surface 43 in contiguous contact with body member 20. Adhesive strip 42 is provided in a predetermined length such that when strip 42 encompasses leg 28 an overlapping portion 48 is provided for adhesively coupling the back surface 43 at the first end 44 of strip 42 to the adhesive surface 41 at the second end 46, in the area of overlap 48. The overlap 48 creates a continuous loop of adhesive material wherein a portion contiguous with front face 21 is adapted to adhesively secure loose threads possibly removed from cloth surface 70 or other surfaces, and a portion contained within slot 27 is maintained fresh and ready for subsequent use.

The adhesive web 40 formed by the adhesive strip 42 having a first end 44 secured to a second end 46 in an overlapping region 48 provides a frictional coupling between adhesive web 40 and body member 20. The frictional coupling between adhesive web 40 and body member 20 provides sufficient coupling therebetween for securing the web to body member 20, while allowing the web to be slidingly displaceable about the leg 28 of body member 20. When the adhesive on the surface 41, juxtaposed to front surface 21, has been consumed the user simply slides the loop to exchange the consumed surface with the unused surface which has been maintained within slot 27. Obviously, at the user's discretion, the web 40 can be slidingly displaced in discrete increments to continuously expose discrete portions of the fresh adhesive surface 41 from within slot 27, until all of the adhesive has been consumed, or completely interchange the entire exposed surface with the portion maintained within slot 27. When the adhesive of the entire loop has been consumed, the tape is simply removed and replaced with a fresh piece to maintain the operability of sewing aid 10.

Adhesive web 40 may be formed from a wide variety of adhesive backed tapes 42 formed by adhesive coating backing materials comprising paper, cloth, or plastic compositions. In one working embodiment, a commercially available tape having the designation of Primeline Offset Pressure Sensitive Label Stock, Basis 60 Pounds available from Baltimore Warner Paper Company of Baltimore, Maryland, has been successfully utilized.

Thus, has been described the unique structure of sewing aid 10 comprising a body member 20 having a pair of extending legs 28 and 29, separated by a slot 27. A continuous adhesive web 40 is formed by an adhesive tape strip 42 wrapped around one of the legs 28 or 29 and providing an adhesive surface 41 exposed in juxtaposition with respective face 21 or 22, while maintaining an adhesive surface 41 available for later use within the slot 27.

Above the portion of face 21 or 22 covered by adhesive web 40 there is provided a space 30 for indicia 32 which may serve an informative or decorative function, or both. On the opposing face 21 or 22 a means for releasably coupling body 20 to a convenient structure, such as a sewing machine 90, is provided thereon. Such may take the form of a Velcro type fastening system wherein either the hook or loop portion 50 is coupled to body member 20 with the cooperating fastening element coupled to the sewing machine. This arrangement provides a compact device easily and conveniently located adjacent the working area where the user may place loose threads thereon. Additionally, the arrangement may provide in an alternate type use, a convenient means to handle and utilize sewing aid 10 without the user's hand 100 having to come in contact with the adhesive web 40.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended Claims.

What is claimed is:

1. A sewing aid releasably coupled to a sewing machine for capturing loose threads, comprising:

a body member having a pair of legs extending from a central body portion defining a U-shaped contour;

adhesive means releasably coupled to one of said legs for adhesively securing said loose threads thereto, said adhesive means including a strip of adhesive backed tape formed in a continuous loop encompassing said leg for frictional engagement therewith, wherein a first portion of said adhesive backed tape is disposed on an external surface of said leg and a second portion is disposed on an internal surface of said leg between said pair of legs, said continuous loop being slidingly displaceable about said leg for exchanging the locations of said first and second respective portions of said adhesive backed tape, whereby said second portion of said continuous loop defining an unused portion of said tape is thus exposed; and, means for releasably coupling said body member to said sewing machine, said means for releasably coupling being disposed on an external surface of the other of said legs.

2. The sewing aid as recited in claim 1 where said body member is formed from a wood material composition.

3. The sewing aid as recited in claim 1 where said body member is formed from a plastic composition.

4. The sewing aid as recited in claim 1 where said body member is formed in one-piece formation.

5. The sewing aid as recited in claim 1 where said means for releasably coupling includes a hook-type fastening element and a loop-type fastening system.

6. The sewing aid as recited in claim 5 where one of said hook-type fastening element or loop-type fastening element is fixedly coupled to said body member and the other of said hook-type element or loop-type element is fixedly coupled to said sewing machine.

7. A sewing aid releasably coupled to a sewing machine for capturing loose threads, comprising:

a body member having a pair of opposing faces and a plurality of end walls, said body member having a slotted opening extending between at least a portion of two opposing end walls and open to another of said plurality of end walls therebetween;

adhesive means for adhesively securing said loose threads thereto, said adhesive means formed in a continuous web for releasable coupling with one of said opposing faces of said body member through said slotted opening, said continuous web being slidingly displaceable about said face of said body member, said continuous web having a first portion disposed in overlapping relationship with said face of said body member and a second portion of said continuous web disposed within said slotted opening whereby positions of at least a portion of said first and second portions of said continuous web are interchanged by said sliding displacement of said continuous web on said body member; and, means for releasably coupling said body member to said sewing machine, said means for releasable coupling being disposed on the other of said two opposing faces of said body member.

8. The sewing aid as recited in claim 7 where said continuous web of said adhesive means is formed by a strip of adhesive backed tape having two opposing ends joined in overlapping relationship to define a continuous loop.

9. The sewing aid as recited in claim 7 where a remaining portion of said face defines an indicia space.

10. The sewing aid as recited in claim 7 where said body member is formed from a wood material composition.

11. The sewing aid as recited in claim 7 where said body member is formed from a plastic material composition.

12. The sewing aid as recited in claim 7 where said body member is formed in one-piece formation.

13. The sewing aid as recited in claim 7 where said means for releasably coupling includes a hook-type fastening element and a loop-type fastening system.

14. The sewing aid as recited in claim 13 where one of said hook-type fastening element or loop-type fastening element is fixedly coupled to said body member and the other of said hook-type element or loop-type element is fixedly coupled to said sewing machine.

* * * * *